US009719051B2

(12) United States Patent
Man et al.

(10) Patent No.: US 9,719,051 B2
(45) Date of Patent: Aug. 1, 2017

(54) TREATMENT OF NON-TRANS FATS WITH ACIDIC TETRA SODIUM L-GLUTAMIC ACID, N, N-DIACETIC ACID (GLDA)

(71) Applicant: Ecolab USA Inc., St. Paul, MN (US)

(72) Inventors: Victor F. Man, St. Paul, MN (US); Yvonne M. Killeen, South St. Paul, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 14/328,948

(22) Filed: Jul. 11, 2014

(65) Prior Publication Data

US 2014/0317859 A1 Oct. 30, 2014

Related U.S. Application Data

(60) Division of application No. 13/717,026, filed on Dec. 17, 2012, now abandoned, and a continuation-in-part of application No. 12/884,422, filed on Sep. 17, 2010, now Pat. No. 8,513,178.

(60) Provisional application No. 61/243,634, filed on Sep. 18, 2009.

(51) Int. Cl.

| | |
|---|---|
| ***C11D 3/33*** | (2006.01) |
| ***C11D 7/32*** | (2006.01) |
| ***C11D 3/00*** | (2006.01) |
| ***C11D 3/36*** | (2006.01) |
| ***C11D 11/00*** | (2006.01) |
| ***C11D 17/04*** | (2006.01) |

(52) U.S. Cl.

CPC ..... *C11D 3/33* (2013.01); *C11D 3/0036* (2013.01); *C11D 3/36* (2013.01); *C11D 7/3245* (2013.01); *C11D 11/0064* (2013.01); *C11D 17/041* (2013.01)

(58) Field of Classification Search

None

See application file for complete search history.

(56) References Cited

U.S. PATENT DOCUMENTS

| | | | |
|---|---|---|---|
| 4,618,914 | A | 10/1986 | Sato et al. |
| 4,830,773 | A | 5/1989 | Olson |
| 5,221,496 | A | 6/1993 | Holland |
| 5,306,444 | A | 4/1994 | Kitamura et al. |
| 5,369,126 | A | 11/1994 | Doran et al. |
| 5,454,237 | A | 10/1995 | Pellerin |
| 5,739,094 | A | 4/1998 | Bowman et al. |
| 5,763,412 | A | 6/1998 | Khan et al. |
| 5,858,941 | A | 1/1999 | Oakes et al. |
| 5,919,745 | A | 7/1999 | Cala et al. |
| 5,968,893 | A | 10/1999 | Manohar et al. |
| 5,986,118 | A | 11/1999 | Fehr et al. |
| 5,998,358 | A | 12/1999 | Herdt et al. |
| 6,004,922 | A | 12/1999 | Watson et al. |
| 6,015,784 | A | 1/2000 | Kazuta et al. |
| 6,225,485 | B1 | 5/2001 | Bertz et al. |
| 6,274,541 | B1 | 8/2001 | Man |
| 6,290,732 | B1 | 9/2001 | Hei et al. |
| 6,350,725 | B1 | 2/2002 | Levitt et al. |
| 6,425,959 | B1 | 7/2002 | Man |
| 6,479,453 | B2 | 11/2002 | Man |
| 6,897,188 | B2 | 5/2005 | Gohl et al. |
| 6,903,060 | B1 | 6/2005 | Dykstra et al. |
| 7,037,884 | B2 | 5/2006 | Man |
| 7,863,237 | B2 | 1/2011 | Rigley et al. |
| 7,971,302 | B2 | 7/2011 | Poy et al. |
| 7,998,278 | B2 | 8/2011 | Hackenberger et al. |
| 8,287,658 | B2 | 10/2012 | Miralles et al. |
| 8,361,950 | B2 | 1/2013 | Man et al. |
| 8,569,220 | B2 | 10/2013 | Gaudreault |
| 8,758,520 | B2 | 6/2014 | Monsrud et al. |
| 2002/0151452 | A1 | 10/2002 | Bullock et al. |
| 2002/0187910 | A1 | 12/2002 | Speed et al. |
| 2003/0216273 | A1 | 11/2003 | Mitra et al. |
| 2004/0028794 | A1 | 2/2004 | Van Buuren et al. |
| 2004/0254090 | A1 | 12/2004 | Lentsch et al. |
| 2005/0153859 | A1 | 7/2005 | Gohl et al. |
| 2006/0111261 | A1 | 5/2006 | Sadlowski et al. |
| 2006/0205628 | A1 | 9/2006 | Deinhammer et al. |
| 2006/0211593 | A1 | 9/2006 | Smith et al. |
| 2007/0033702 | A1 | 2/2007 | Hsu |
| 2008/0015133 | A1 | 1/2008 | Rigley et al. |
| 2008/0276973 | A1 | 11/2008 | Miralles et al. |
| 2009/0011971 | A1* | 1/2009 | Evers ..... 510/296 |
| 2009/0119847 | A1 | 5/2009 | Arai et al. |
| 2009/0264329 | A1 | 10/2009 | Underwood et al. |
| 2010/0170303 | A1 | 7/2010 | Gohl et al. |
| 2010/0229897 | A1 | 9/2010 | Miralles et al. |
| 2011/0107527 | A1 | 5/2011 | De Buzzaccarini et al. |
| 2011/0251116 | A1 | 10/2011 | Aehle et al. |
| 2011/0296626 | A1 | 12/2011 | Poy |
| 2012/0023680 | A1 | 2/2012 | Poy et al. |
| 2012/0129751 | A1* | 5/2012 | Miracle et al. ..... 510/295 |
| 2013/0111675 | A1* | 5/2013 | Soontravanich et al. ..... 8/137 |
| 2013/0192006 | A1 | 8/2013 | Tinker et al. |
| 2014/0165294 | A1 | 6/2014 | Wilker et al. |
| 2014/0186922 | A1 | 7/2014 | Estell et al. |
| 2014/0349372 | A1 | 11/2014 | Erlandsen et al. |

FOREIGN PATENT DOCUMENTS

| | | |
|---|---|---|
| CA | 1226782 | 9/1987 |
| EP | 0825250 | 2/1998 |
| WO | WO9950380 | 10/1999 |
| WO | WO 2007/004622 A1 | 1/2007 |
| WO | 2008008063 A1 | 1/2008 |
| WO | WO2012036700 | 9/2010 |
| WO | WO 2011/056935 A1 * | 5/2011 |
| WO | WO 2013/032493 A1 * | 3/2013 |

OTHER PUBLICATIONS

Süd-Chemie AG, "Tonsil® Highly Active Bleaching Earths", 10 pages, date unknown.

(Continued)

*Primary Examiner* — Lorna Douyon

(74) *Attorney, Agent, or Firm* — Merchant & Gould P.C.

(57) ABSTRACT

The invention relates to methods and compositions for treating non-trans fats with a souring composition that acts as both a souring agent and a chelating agent. The invention also relates to methods for reducing the frequency of laundry fires with acidic GLDA.

12 Claims, 11 Drawing Sheets

(56) References Cited

OTHER PUBLICATIONS

International Search Report and Written Opinion for PCT/US2013/055279), mailed Nov. 11, 2013.
Beggs "Tunnel Washer or Extractors: What's the Proper Choice? (Part 1)" Jul. 22, 2016.
International Search Report and Written Opinion, dated May 26, 2016, (PCT/US2016/012928).
Gurtler Industries, Inc., "Technical Service Report" Hibiclens, Antiseptic Skin Preparation (2008), http://www.regentmedical.com/americas/hibiclens laundry.html.

* cited by examiner (Oleic Acid)

(Linoleic Acid)

DSC (Linolenic Acid)

DSC

Oil DSC Heat of Polymerization Baseline Summary
24 hour presoak

Spontaneous Combustion
Linseed Oil and Soybean Oil Preliminary Data

Spontaneous Combustion
Effect of chelating Agent on Iron Spiked soybean Oil

TREATMENT OF NON-TRANS FATS WITH ACIDIC TETRA SODIUM L-GLUTAMIC ACID, N, N-DIACETIC ACID (GLDA)

This application is a divisional of U.S. application Ser. No. 13/717,026 filed Dec. 17, 2012 now abandoned, which is a Continuation-in-Part of U.S. application Ser. No. 12/884,422, now U.S. Pat. No. 8,513,178 filed Sep. 17, 2010, which claims the benefit under 35 U.S.C. §119(e) to U.S. Provisional Patent Application 61/243,634, filed on Sep. 18, 2009, entitled "Treatment of Non-Trans Fats and Fatty Acids with a Chelating Agent," all of which are incorporated herein by reference in their entirety for all purposes.

FIELD OF THE INVENTION

The invention relates to a composition for treating non-trans fats with tetra sodium L-glutamic acid, N, N-diacetic acid (GLDA) in an acidic form. The invention also relates to methods for laundering an article that is contacted with a non-trans fat soil by treating the non-trans fat soil with GLDA.

BACKGROUND OF THE INVENTION

Health authorities have recently recommended that trans fats be reduced or eliminated in diets because they present health risks. In response, the food industry has largely replaced the use of trans fats with non-trans fats. However, the replacement of trans fats with non-trans fats poses new concerns over the need and ability to clean and remove such soils from a variety of surfaces. Non-trans fat soils and other soils form thickened liquid, semi-solid or solid soils on a variety of surfaces, presenting soils that are very difficult to remove from surfaces. After replacing the use of trans fats with non-trans fats, the food industry has also experienced an unexplained higher frequency of laundry fires. Non-trans fats are prone to cause fire due to their substantial heat of polymerization. Non-trans fats have conjugated double bonds that can polymerize and the substantial heat of polymerization involved can cause spontaneous combustion or fire, for example, in a pile of rags used to mop up these non-trans fat soils. As can be seen, there is a need in the industry for improvement of cleaning compositions, such as hard surface and laundry detergents so that difficult soils such as non-trans fat soils can be removed in a safe, environmentally friendly, and effective manner.

SUMMARY OF THE INVENTION

The invention meets the needs above by incorporating an effective amount of tetra sodium L-glutamic acid, N, N-diacetic acid (GLDA) in an acidic form acting as both a chelating agent and a souring agent. The GLDA can be used alone as a pretreatment, in combination with traditional cleaning compositions, as a part of a laundry detergent or rinse treatment, or as a hard surface cleaner or as a component to form emulsions and microemulsions. The acidic form of GLDA is capable of hindering polymerization of non-trans fats as well as lowering an area of exothern of the non-trans fat soils and delaying a time of peak heat flow of the non-trans fat soils.

The invention has many uses and applications, which include but are not limited to laundry cleaning, reduction of laundry fires due to non-trans fats, hard surface cleaning such as manual pot-n-pan cleaning, machine warewashing, all purpose cleaning, floor cleaning, CIP cleaning, open facility cleaning, foam cleaning, vehicle cleaning, etc.

In one embodiment a souring composition is disclosed which includes acidic GLDA in an effective amount to hinder polymerization of non-trans fat soils and wherein the effective amount of acidic GLDA is an amount that acts as both a souring agent and a chelating agent. This composition can be used in formulations for laundry detergents, hard surface cleaners, whether alkali or acid based or even by itself as a pre-spotting agent.

In another embodiment a method of laundering an article that is contacted with a non-trans fat soil is disclosed wherein an effective amount of acidic GLDA is added to the article to hinder polymerization of the non-trans fat soil and therefore prevent spontaneous combustion or fire of the article.

These and other objects, features and attendant advantages of the present invention will become apparent to those skilled in the art from a reading of the following detailed description of the preferred embodiment and the appended claims.

DETAILED DESCRIPTION OF THE INVENTION

Figure 1:
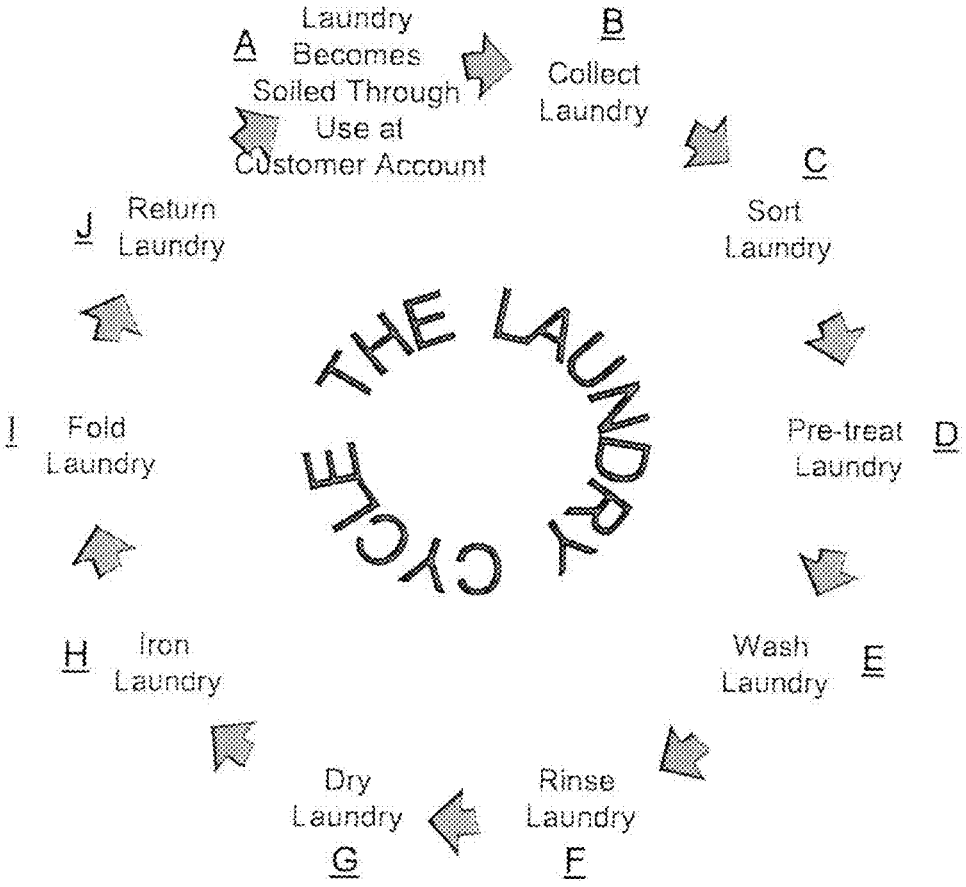
FIG. 1 is a flowchart of a typical laundry process in the food industry.

So that the invention maybe more readily understood, certain terms are first defined and certain test methods are described.

As used herein, "weight percent," "wt-%," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt-%," etc.

As used herein, the term "about" refers to variation in the numerical quantity that can occur, for example, through typical measuring and liquid handling procedures used for making concentrates or use solutions in the real world;

through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

It should be noted that, as used in this specification and the appended claims, the singular forms "a," "an," and "the" include plural referents unless the content clearly dictates otherwise. Thus, for example, reference to a composition containing "a compound" includes a composition having two or more compounds. It should also be noted that the term "or" is generally employed in its sense including "and/or" unless the content clearly dictates otherwise.

The term "hard surface" refers to a solid, substantially non-flexible surface such as a counter top, tile, floor, wall, panel, window, plumbing fixture, kitchen and bathroom furniture, appliance, engine, circuit board, and dish.

The term "soft surface" refers to a softer, highly flexible material such as fabric, carpet, hair, and skin.

As used herein, the term "cleaning" refers to a method used to facilitate or aid in soil removal, bleaching, microbial population reduction, and any combination thereof. "Soil" or "stain" refers to a non-polar oily substance which may or may not contain particulate matter such as mineral clays, sand, natural mineral matter, carbon black, graphite, kaolin, environmental dust, etc.

The term "laundry" refers to items or articles that are cleaned in a laundry washing machine. In general, laundry refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated.

Exemplary treated fibers include those treated for flame retardancy. It should be understood that the term "linen" is often used to describe certain types of laundry items including bed sheets, pillow cases, towels, table linen, table cloth, bar mops and uniforms. The invention additionally provides a composition and method for treating non-laundry articles and surfaces including hard surfaces such as dishes, glasses, and other ware.

Chelating Agents

The discovery of the link between non-trans fats and laundry fires resulted in the present invention for compositions for treating non-trans fat soils. Due to the significant risk of thermal polymerization resulting in fires, compositions preventing the polymerization of non-trans fats are needed to prevent such risk of fires and represent ideal compositions for cleaning non-trans fat soiled surfaces. Polymerization of non-trans fats results from the unsaturated bonds of the fats, generating significant amount of heat. The higher energy state of the trans configuration causes heat from one double bond to heat the next double bond, resulting in a chain reaction.

According to a preferred embodiment of the invention, the inclusion of a chelating agent to reduce heavy metals in surfaces soiled with non-trans fats (namely textiles) such as soybean oil, to impede polymerization of the non-trans fats, results in a reduction of spontaneous combustion.

The chelating agent of the soil release composition is capable of hindering or reducing the polymerization of the non-trans fats. The chelating agent is also capable of hindering metal complexation by forming chelation complexes with metal ions. Non-trans fat oils contain heavy metal ions that act as oxidative catalysts in the polymerization of the oils; further, the cooking process of non-trans fat oils also results in the addition of heavy metal ions due to the oils often being cooked in metal surfaces (e.g. metal pots and pans). Accordingly, the chelating agent of the soil release composition must be capable of chelating the metal ions of the non-trans fat soil on the pretreated surface to relieve the heavy metals as well as hinder polymerization of the non-trans fat soils according to the methods of the invention.

Cleaning Compositions Comprising Acidic GLDA

The acidic GLDA of the invention may be used alone, as a pre-treatment composition in combination with a traditional detergent or cleaner, or may be incorporated within a cleaning composition. The invention comprises both hard surface and soft surface cleaning compositions.

In one embodiment, the invention employs the acidic GLDA of the invention to make a souring composition which will be effective at acting as both a souring agent and chelating agent to lower an area of exotherm, delay a time of peak heat flow of the non-trans fat soil, hinder metal complexation of free fatty acid salts, prevent skin irritation, lower the pH of the article during a rinsing step in a laundry cycle, prevent fire in the article that is in contact with the non-trans fat soil, and neutralize any left-over alkalinity from a detergent step in a laundry cycle.

A method of laundering an article that is contacted with a non-trans fat soil is also provided, which includes the steps of providing a cleaning article bearing a non-trans fat and treating the article with an effective amount of GLDA in acidic form during or after the article is laundered in the rinsing step, wherein the effective amount is an amount that hinders polymerization of the non-trans fat and acts as a souring agent in the rinsing step and decreases the pH of the article.

Formation of Microemulsions

A microemulsion forming formula can serve in the pretreating step at stage D of FIG. 1. Preferably, the microemulsion forming formula includes an extended surfactant as described above.

Table 1 illustrates microemulsion formulas including 10% and 20% GLDA.

TABLE 1

| | 10% GLDA | 20% GLDA |
|---|---|---|
| DI Water | 62.34 | 52.34 |
| X-AES, 23% | 14.36 | 14.36 |
| Plurafac SL-42 | 3.30 | 3.30 |
| Barlox 12, 30% | 10.00 | 10.00 |
| GLDA, 38% | 10.00 | 20.00 |
| TOTAL | 100.00 | 100.00 |
| Cloud Point, ° F. | 131 | ~90 |
| % Active Chelant | 3.8 | 7.6 |
| % Active Surfactant | 9.6 | 9.6 |

Optional Surfactants

Optional surfactants may be included in the souring composition of the present invention. The surfactant or surfactant admixture can be selected from water soluble or water dispersible nonionic, semi-polar nonionic, anionic, cationic, amphoteric, or zwitterionic surface-active agents; or any combination thereof. The particular surfactant or surfactant mixture chosen can depend on the conditions of final utility, including method of manufacture, physical product form, use pH, use temperature, foam control, and soil type. Surfactants incorporated into the souring compositions of the present invention are preferably enzyme compatible, not substrates for the enzyme, and not inhibitors or inactivators of the enzyme. For example, when proteases and amylases are employed in the present compositions, the surfactant is preferably free of peptide and glycosidic bonds. In addition, certain cationic surfactants are known in the art to decrease enzyme effectiveness.

A preferred surfactant system of the invention can be selected from amphoteric species of surface-active agents, which offer diverse and comprehensive commercial selection, low price; and, most important, excellent detersive effect—meaning surface wetting, soil penetration, soil removal from the surface being cleaned, and soil suspension in the detergent solution. Despite this preference the present composition can include one or more of nonionic surfactants, anionic surfactants, cationic surfactants, the sub-class of nonionic entitled semi-polar nonionics, or those surface-active agents which are characterized by persistent cationic and anionic double ion behavior, thus differing from classical amphoteric, and which are classified as zwitterionic surfactants.

Generally, the concentration of surfactant or surfactant mixture useful in souring compositions of the present invention fall in the range of from about 0.5% to about 40% by weight of the composition, preferably about 2% to about 10%, preferably about 5% to about 8%. These percentages can refer to percentages of the commercially available surfactant composition, which can contain solvents, dyes, odorants, and the like in addition to the actual surfactant. In this case, the percentage of the actual surfactant chemical can be less than the percentages listed. These percentages can refer to the percentage of the actual surfactant chemical.

Preferred surfactants for the compositions of the invention include amphoteric surfactants, such as dicarboxylic coconut derivative sodium salts.

A typical listing of the classes and species of surfactants useful herein appears in U.S. Pat. No. 3,664,961 issued May 23, 1972, to Norris.

Surface Modifying Agents

Surface Modifying Agents may be optionally included in the souring composition of the present invention. Exemplary commercially available surface modifying agents include, but are not limited to: sodium silicate, sodium metasilicate, sodium orthosilicate, potassium silicate, potassium metasilicate, potassium orthosilicate, lithium silicate, lithium metasilicate, lithium orthosilicate, aluminosilicates and other alkali metal salts and ammonium salts of silicates. Exemplary commercially available acrylic type polymers include acrylic acid polymers, methacrylic acid polymers, acrylic acid-methacrylic acid copolymers, and water-soluble salts of the said polymers. These include polyelectrolytes such as water soluble acrylic polymers such as polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, hydrolyzed methacrylamide, hydrolyzed acrylamide-methacrylamide copolymers, and combinations thereof. Such polymers, or mixtures thereof, include water soluble salts or partial salts of these polymers such as their respective alkali metal (for example, sodium or potassium) or ammonium salts can also be used. The weight average molecular weight of the polymers is from about 2000 to about 20,000.

Optional Cleaning Enhancement Agents

Optional cleaning enhancement agents can be included in the souring composition, such as sulfite and peroxygen based compounds. In some embodiments, sulfite sources are included, such as water soluble salts of sulfite ion ($SO_3^{-2}$), bisulfite ion ($HSO_3^-$), meta bisulfite ion ($S_2O_5^{-2}$) and hydrosulfite ion ($S_2O_4^{-2}$) and mixtures thereof. In other embodiments, peroxygen compounds are included. Peroxygen compounds, include, but are not limited to, hydrogen peroxide, peroxides and various percarboxylic acids, including percarbonates, can be used with the methods of the present invention. Peroxycarboxylic (or percarboxylic) acids generally have the formula $R(CO_3H)n$, where, for example, R is an alkyl, arylalkyl, cycloalkyl, aromatic, or heterocyclic group, and n is one, two, or three, and named by prefixing the parent acid with peroxy. The R group can be saturated or unsaturated as well as substituted or unsubstituted. Medium chain peroxycarboxylic (or percarboxylic) acids can have the formula $R(CO_3H)n$, where R is a $C_5$-$C_{11}$ alkyl group, a $C_5$-$C_{11}$ cycloalkyl, a $C_5$-$C_{11}$ arylalkyl group, $C_5$-$C_{11}$ aryl group, or a $C_5$-$C_{11}$ heterocyclic group; and n is one, two, or three. Short chain perfatty acids can have the formula $R(CO_3H)n$ where R is $C_1$-$C_4$ and n is one, two, or three.

Exemplary peroxycarboxylic acids for use with the present invention include, but are not limited to, peroxypentanoic, peroxyhexanoic, peroxyheptanoic, peroxyoctanoic, peroxynonanoic, peroxyisononanoic, peroxydecanoic, peroxyundecanoic, peroxydodecanoic, peroxyascorbic, peroxyadipic, peroxycitric, peroxypimelic, or peroxysuberic acid, mixtures thereof, or the like.

Branched chain peroxycarboxylic acids include peroxyisopentanoic, peroxyisononanoic, peroxyisohexanoic, peroxyisoheptanoic, peroxyisooctanoic, peroxyisonananoic, peroxyisodecanoic, peroxyisoundecanoic, peroxyisododecanoic, peroxyneopentanoic, peroxyneohexanoic, peroxyneoheptanoic, peroxyneooctanoic, peroxyneononanoic, peroxyneodecanoic, peroxyneoundecanoic, peroxyneododecanoic, mixtures thereof, or the like.

Additional exemplary peroxygen compounds include hydrogen peroxide ($H_2O_2$), peracetic acid, peroctanoic acid, a persulphate, a perborate, or a percarbonate. In some embodiments, the active oxygen use solution cleaning composition comprises at least two, at least three, or at least four active oxygen sources. In other embodiments, the cleaning composition can include multiple active oxygen sources, for example, active oxygen sources that have a broad carbon chain length distribution. In still yet other embodiments, For example, combinations of active oxygen sources for use with the methods of the present invention can include, but are not limited to, peroxide/peracid combinations, and peracid/peracid combinations. In other embodiments, the active oxygen use solution comprises a peroxide/acid or a peracid/acid composition.

Optional Thickening Agents

Optional thickening agents can be included in the souring composition to enhance residence time on the laundry. Suitable thickening agents include, but are not limited to, natural polysaccharides such as xanthan gum, carrageenan and the like; or cellulosic type thickeners such as carboxymethyl cellulose, and hydroxymethyl-, hydroxyethyl-, and hydroxypropyl cellulose; or, polycarboxylate thickeners such as high molecular weight polyacrylates or carboxyvinyl polymers and copolymers; or, naturally occurring and synthetic clays; and finely divided fumed or precipitated silica, to list a few.

Diluent(s)

The souring composition of the present invention can be formulated in a concentrated form which then may be diluted to the desired concentration merely with water at the intended use location. Ordinary tap water, softened water or process water may be employed. The composition concentrates and various dilutions of these concentrates (typically can be used at full strength concentrate down to a 1:100 concentrate: water dilution) can be used on polymerized non-trans fat soils of various difficulties to remove. (A more difficult to remove polymerized non-trans fat soil will generally have a higher level of polymerization.) A variety of mixing methods may be employed (such as automated or manual dilutions) and various levels of additives, such as thickening agents, can be mixed in with the diluted composition depending on the specific needs of the cleaning operation.

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques. All references cited herein are hereby incorporated in their entirety by reference.

EXAMPLES

Test Procedures

Differential Scanning calorimetry Technique (DSC)

Applicant used an isothermal differential scanning calorimetry technique (DSC) in certain test methods described below. DSC is a thermoanalytical technique that measures the difference in heat flow rate between a test fabric sample and reference fabric sample as a function of time and temperature. In Applicant's DSC method, Applicant sealed test samples in hermetic DSC pans to trap oxygen with each sample. Applicant also sealed a control sample in a hermetic DSC pan. Applicant then held each sample at a constant temperature (e.g., 130° C.) for an extended period of time (e.g., 120 minutes) while performing a DSC on each sample, using a DSC calorimeter (e.g., a DSC from TA Instruments Q200). The DSC calorimeter measured the rate and amount of heat released by each sample at the constant temperature as a function of time. Applicant then generated DSC curves by plotting heat flow (W/g) versus time (minutes). Applicant used the reference sample to establish a baseline. For each test sample, Applicant chose a flat region of the baseline after heat release is complete and extrapolated the baseline back towards zero minutes. Applicant then quantified the amount of heat released by the sample (i.e., the area of exotherm) by integrating the area between the heat flow curve and extrapolated baseline. Also, instrument thermal lag causes an initial start-up hook in the DSC curve before heat flow stabilizes. Applicant used the heat released by the control sample to quantify the instrument thermal lag contribution to actual test samples and to determine the time of peak heat flow.

By using DSC, Applicant simulated the Differential Mackey Test, ASTM D3523, which measures the spontaneous heating value of a liquid or solid that is expected to occur upon exposure of the sample to air at a test temperature. Applicant's DSC curves allowed Applicant to study the tendency of a test fabric to self-heat to the point of spontaneous combustion. The area of exotherm and time of peak heat flow of a sample is believed to be directly related to its propensity to spontaneously combust.

Commercial Detergent Used for Testing

Applicant uses the terms "commercial detergent A" and "commercial detergent B". Commercial detergent A is an alcohol ethoxylated based composition and Commercial Detergent B is a NPE based composition.

Examples of Non-Trans Fat Soil Removal

Applicant has identified several reasons for the sudden increase in frequency of laundry fires. The food industry now uses almost exclusively non-trans fats for cooking. Applicant has concluded that a link exists between these non-trans fats and laundry fires. In order to explore this link, Applicant compared certain properties of linseed oil, soybean oil, olive oil, lard, and trans fat. These properties are summarized in Table 2 below. Linseed oil is a drying oil commonly used in paints, which is well known for its ability to cause a large, compact mass of rags soaked in the oil to ignite spontaneously. Soybean oil and olive oil are non-trans fat oils commonly used by the food industry. Lard has a large percentage of saturated fatty acid triglyceride and trans fats are unsaturated fatty acids in a lower energy state in the trans configuration.

TABLE 2

| | Oleic Acid 18:1 | Linoleic Acid 18:2 | Linolenic Acid 18.3 | Iodine Value | Heat of Polymerization |
|---|---|---|---|---|---|
| Linseed Oil | 19 | 24 | 47 | 178 | High |
| Soybean Oil | 24 | 54 | 7 | 130 | High |
| Olive Oil | 71 | 10 | 1 | 81 | Medium to Low |
| Lard | 44 | 10 | 0 | 65 | Low |
| Trans fat | ~100 (trans configuration) | | | | Very Low |

As shown in Table 2, soybean oil has similarities to linseed oil. Both contain higher concentrations of linoleic acid and linolenic acid triglycerides. Linoleic acid contains two conjugated double bonds and linolenic acid contains three conjugated double bonds. When linolenic acid reaches auto-ignition temperature, the heat from one double bond heats up the next double bond, causing a chain reaction. As a result, laundry textiles soaked in oils high in linolenic acid can spontaneously combust. The more linolenic acid present on the textile, the greater the chance of spontaneous combustion. Additionally, both oils have an iodine value of 130 or higher. Oils with this iodine value are considered drying oils that have a high number of conjugated double bonds that can lead to polymerization. Finally, both oils have a high heat of polymerization. Here, Applicant established that laundry textiles bearing non-trans fat oils such as soybean oil have a greater chance of spontaneously combusting. On the other hand, a highly saturated fat such as lard has a lower concentration of linoleic acid and linolenic acid, a low iodine value and a low heat of polymerization. A trans fat is created with a catalyzed partial hydrogenation process that eliminates most of the double bonds with the remaining double bonds in a lower energy state trans configuration. As such, textiles bearing trans fat oils are far less likely to spontaneously combust.

Figure 2:
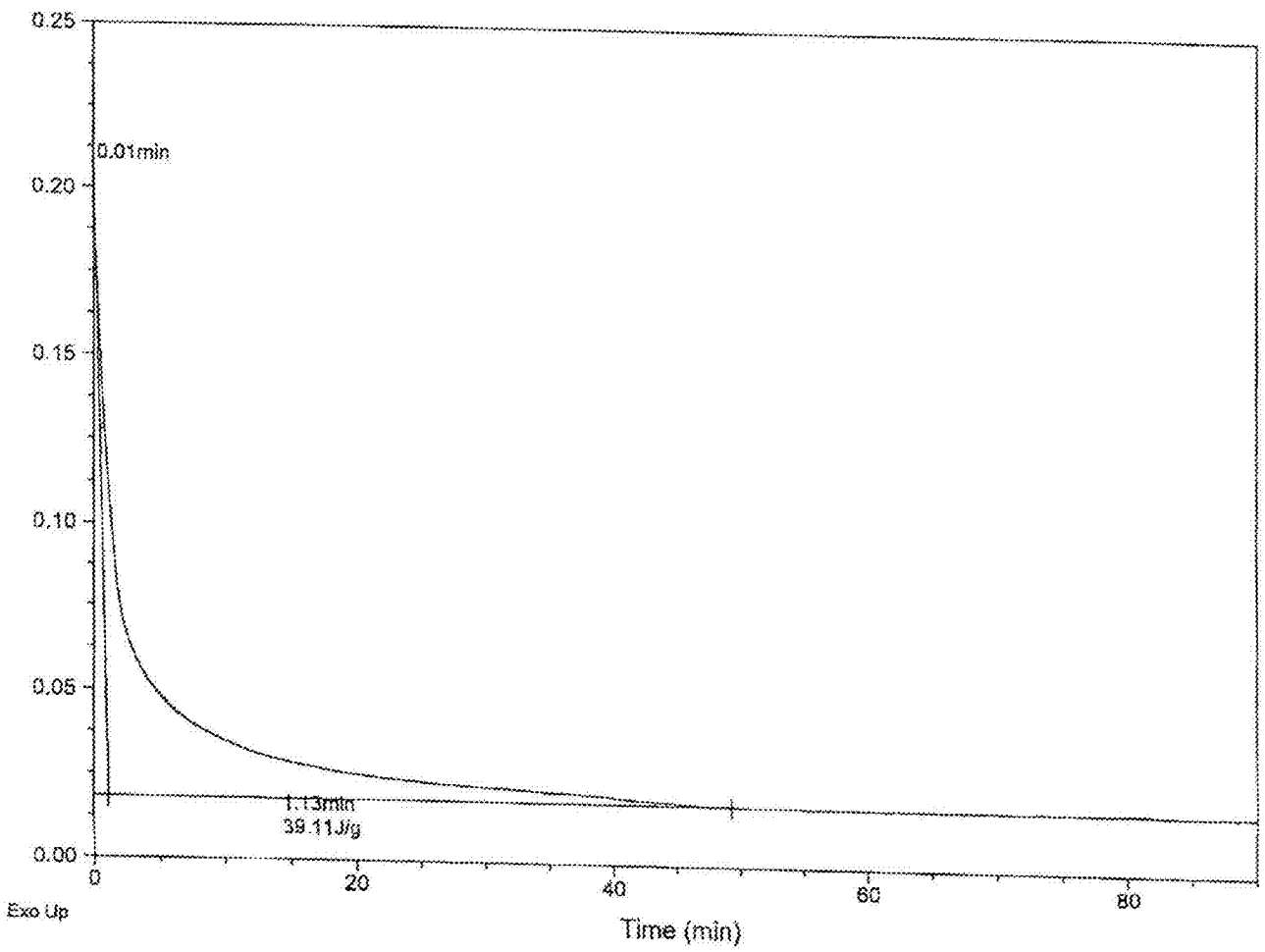
FIG. 2 is a DSC chart for a cotton terry swatch containing oleic acid.
Figure 3:
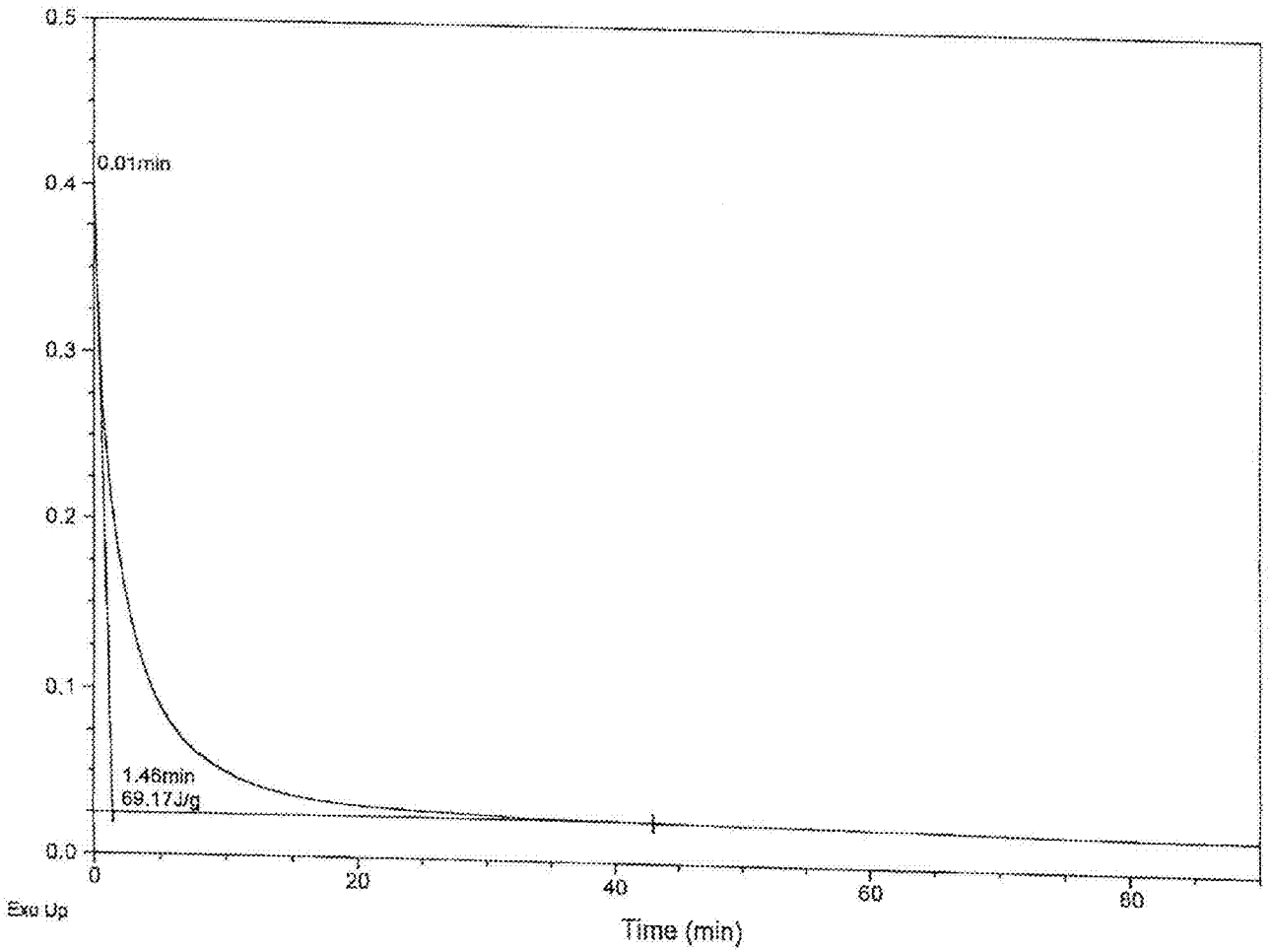
FIG. 3 is a DSC chart for a cotton terry swatch containing linoleic acid.
Figure 4:
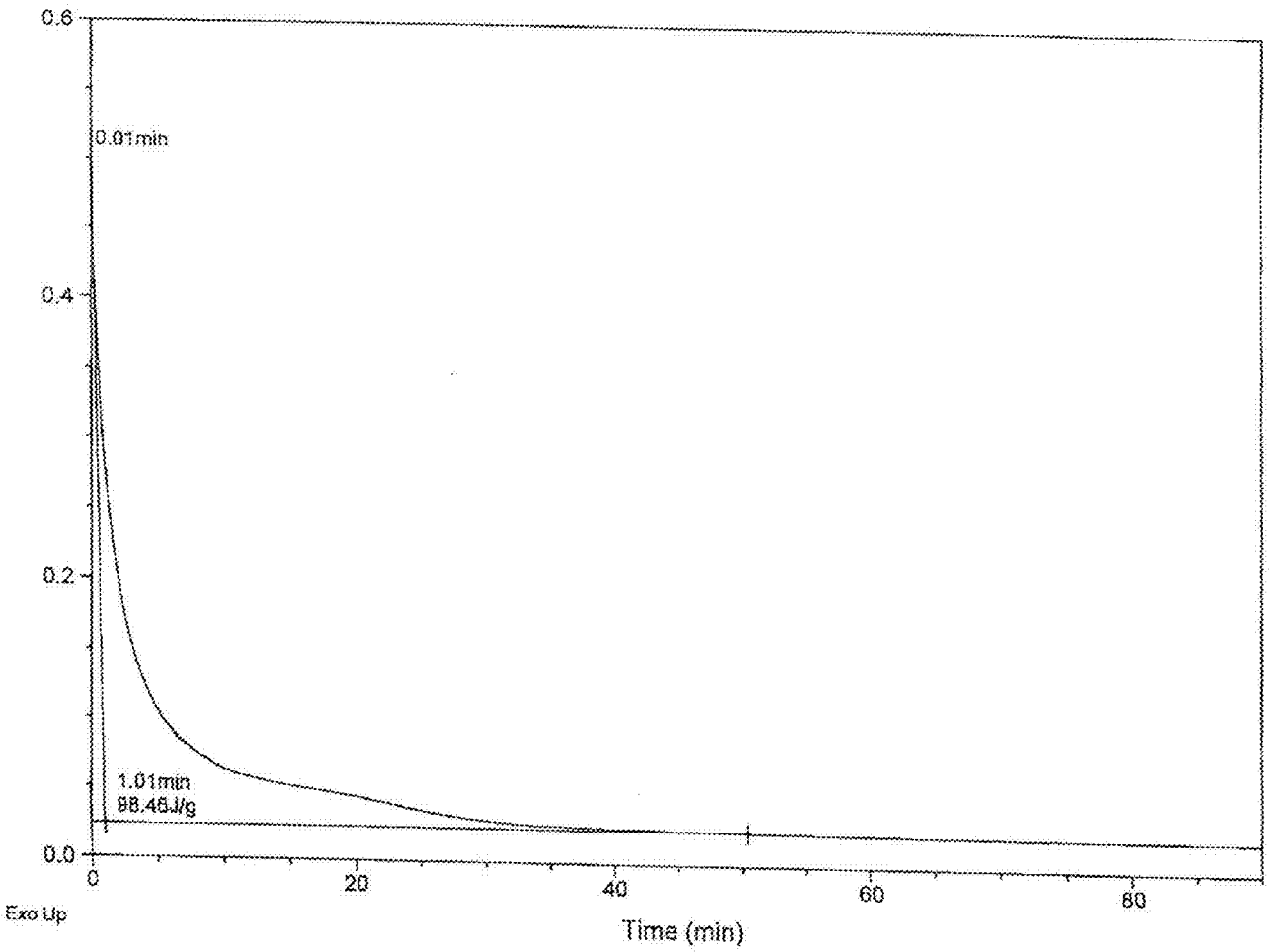
FIG. 4 is a DSC chart for a cotton terry swatch containing linolenic acid.

Applicant used a DSC technique to determine the area of exotherm and time of peak values for oleic acid, linoleic acid and linolenic acid. The DSC charts obtained for oleic acid, linoleic acid and linolenic acid are illustrated in FIGS. 2, 3 and 4, respectively. The area of exotherm values are summarized in Table 3 below. As shown, linolenic acid has a higher area of exotherm than both oleic acid and linoleic acid. The higher the area of exotherm, the more likely an acid is to spontaneously combust. Thus, non-trans fats such as soybean oil contain more linoleic and linolenic acids, making them more likely to combust and thus contributing to the high frequency of laundry fires. More importantly, the free unsaturated fatty acids exotherm immediately and with much higher magnitude than the triglycerides, suggesting they can be a more problematic by product in a spent triglyceride (for example, by hydrolysis).

TABLE 3

| | Area of Exotherm (J/g) |
|---|---|
| Oleic Acid | 38.7 |
| Linoleic Acid | 102.6 |
| Linolenic Acid | 120.9 |

Applicant also discovered that non-trans fat oils contain heavy metal ions that act as oxidative catalysts in polymerization. There also appears to be a link between these heavy metal ions and the frequency of laundry fires. Skilled artisan previously did not explore such a link, because non-trans fat oils are initially treated and purified to remove heavy metal ions. However, Applicant noted that these purification processes are not always complete, allowing some heavy metal ions to remain in the oil. Applicant also discovered that non-trans fat oils pick up additional heavy metal ions from cooking processes. For example, oils cooked in metals (e.g. metal pots and pans) have more heavy metal ions than oils cooked in non-metals. In one example, Applicant observed the effect on the rate of polymerization from the cooking of soybean oil in stainless steel, ceramic and glass. Equal amount of soybean oil was spread on stainless steel, ceramic and glass substrates and subjected to different durations of baking in an oven maintained at 375° F. The rate of polymerization of the soybean oil was compared immediately after taking the substrates out of the oven. The test results showed a trend of stainless steel>ceramic>glass in the rate of polymerization of the oil.

Thus, non-trans fat oils indeed pick up additional heavy metal ions from cooking processes. Cooking processes can also produce more free fatty acids, making non-trans fat oils even more combustible. The free fatty acids can also form lime soaps, making it more difficult to remove oils from laundry textiles. In turn, operators use old rags and towels to clean additional non-trans fat oil soils and spills. Upon repeated laundry processes, old laundry textiles appear to have accumulated heavy metal ions that aid in polymerization.

After discovering that heavy metal ions increase the rate of polymerization in non-trans fat oils, Applicant sought out a way to pacify these metal ions as catalysts. Applicant tested various approaches, such as enhancing redeposition agents, using antioxidants, adding alkalinity, adding solvents, adding surfactants, including enzymes, providing an oxygen barrier to fabrics, adding fire retardants, adding free radical depolymerizers, and adding chelating agents. Applicant has surprisingly found great success using chelating agents, specifically GLDA in an acidic form. Applicant has now discovered that by treating non-trans fats with GLDA in an acidic form, the heavy metal oxidizing catalysts are pacified, thus reducing or hindering polymerization. Moreover, GLDA in an acidic form acts as a souring agent in the rinsing step and decreases the pH of the article. The following examples illustrate the effect of treating non-trans fat oil with GLDA in an acidic form.

Figure 5:
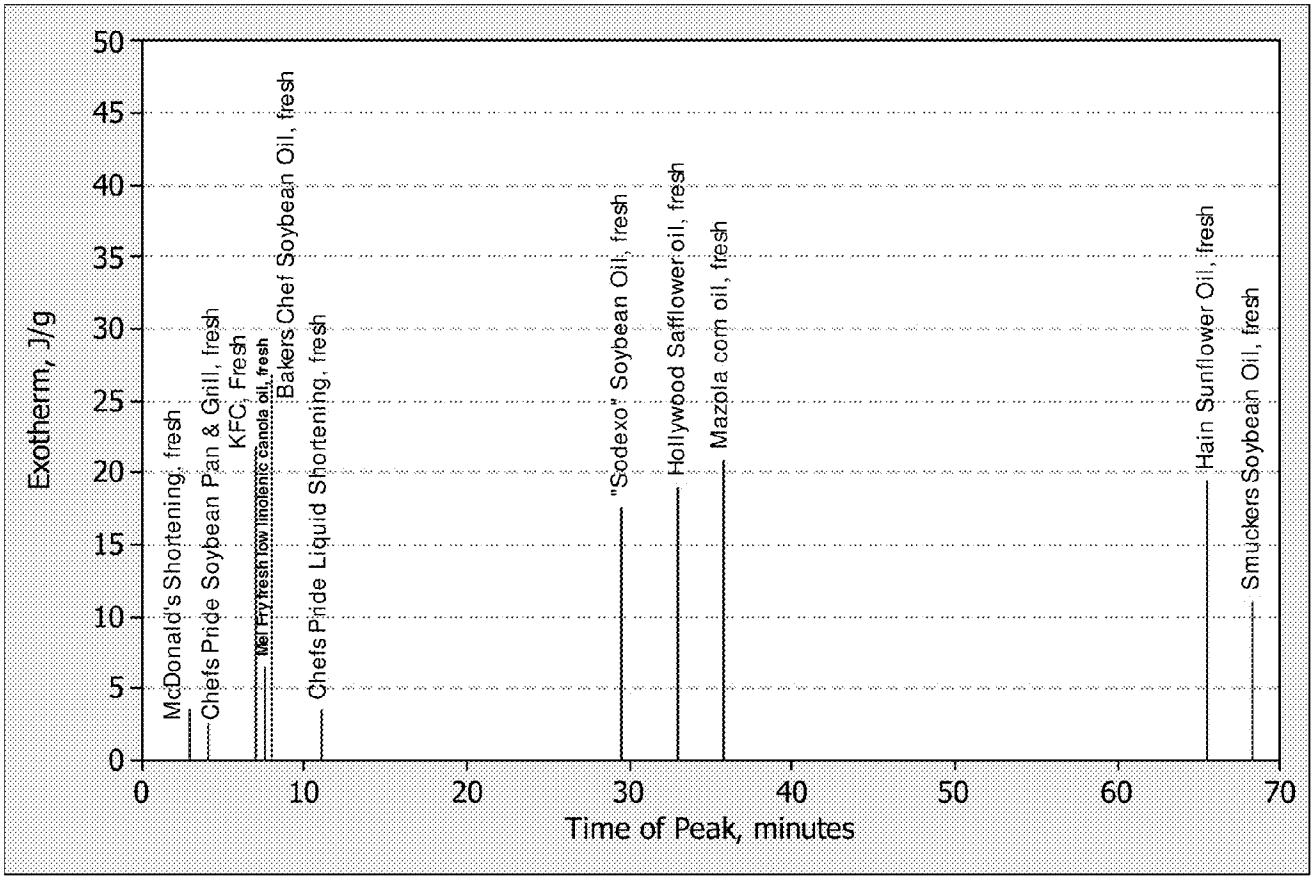
FIG. 5 is a graph showing area of exotherm and time of peak values for certain fresh soybean oils.

Applicants have studied many different non-trans fat oils with the DSC method. These values are illustrated in FIG. 5. These appear to correlate with the compositions of polyunsaturation. For example, the Mel Fry oil is a low linolenic canola oil and shows a very low exotherm (low fire hazard). Thus, Applicant can analyze the oil compositions and design a souring agent and treatment program accordingly.

Example #1

Figure 6:
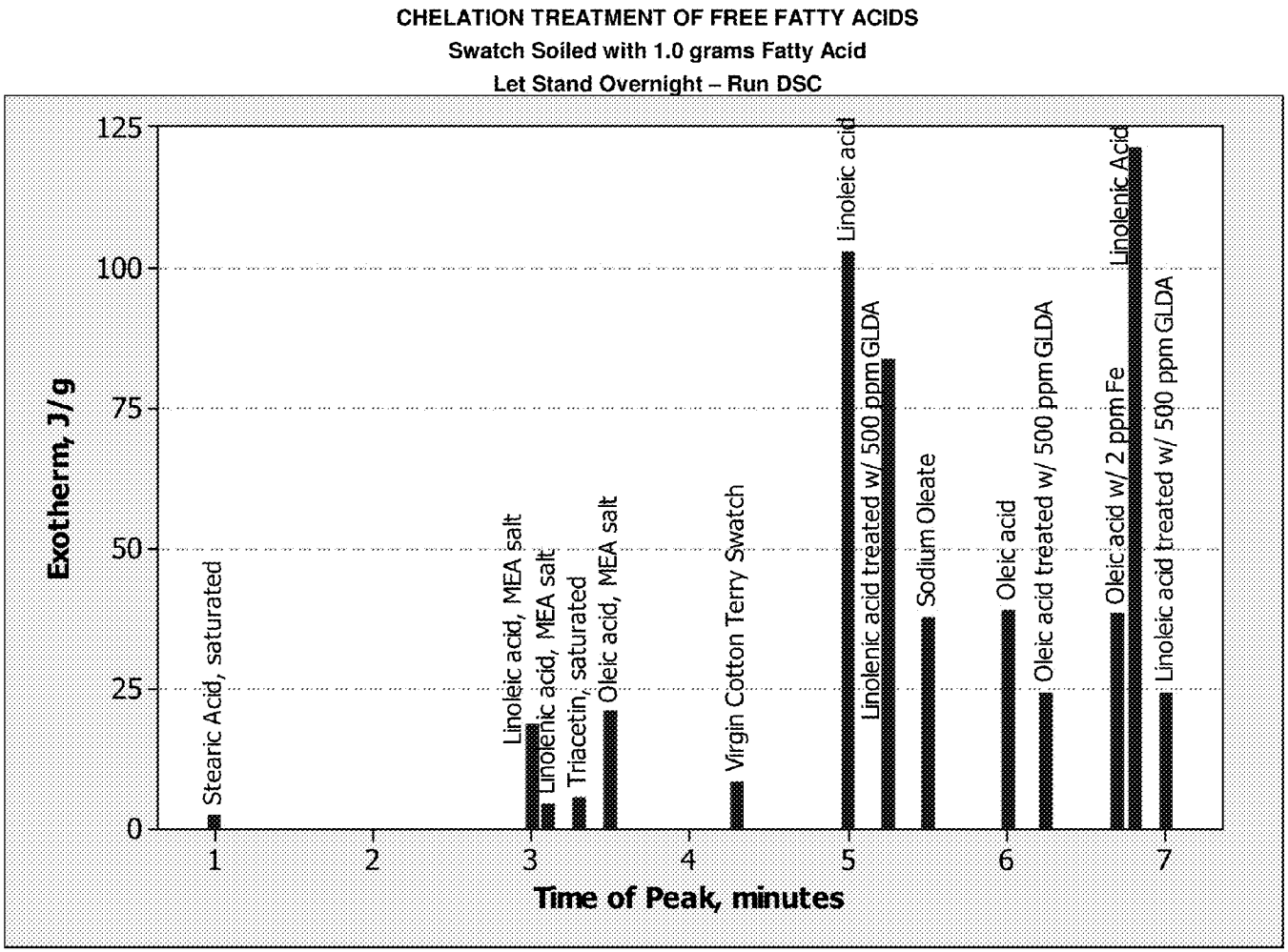
FIG. 6 is a graph showing area of exotherm and time of peak values for cotton terry swatches soiled with free fatty acids treated variously and left to stand overnight.

Applicant ran DSC curves on the following saturated triglyceride and saturated fatty acid: Triacetin and Stearic Acid. The results are displayed in Table 4 below and FIG. 6. As can be seen from examples #1 and #2, the saturated triglyceride and saturated free fatty acid are less dangerous than the unsaturated fatty acids, which have a much lower magnitude of exotherm.

TABLE 4

| | Average | |
|---|---|---|
| Acid Type | Area of Exotherm (g/L) | Time of Peak (min) |
| Triacetin | 5.59 | 4.25 |
| Stearic Acid | 2.33 | 1.0 |

Example #2

Applicant compared unsaturated free fatty acids (oleic acid, linoleic acid and linolenic acid) treated (neutralized) with MEA or sodium hydroxide. Applicant applied one gram of treated (neutralized) free fatty acid to a swatch. The swatches were allowed to air dry for 24 hours and then DSC curves were generated. Results are displayed in table 5 and FIG. 6. This shows that the salt of the fatty acid lowers the magnitude of exotherm and extends the time of peak.

TABLE 5

| | Average of Untreated Fatty Acid | | Average of MEA Treated Fatty Acid | | Average of NaOH Treated Fatty Acid | |
|---|---|---|---|---|---|---|
| Acid Type | Area of Exotherm (g/L) | Time of Peak (min) | Area of Exotherm (g/L) | Time of Peak (min) | Area of Exotherm (g/L) | Time of Peak (min) |
| Oleic Acid | 38.7 | 6 | 20.8 | 3 | 37.6 | 6 |
| Linoleic Acid | 102.6 | 5 | 18.7 | 3 | | |
| Linolenic Acid | 120.9 | 7 | 4.4 | 3 | | |

Example #3

Applicant performed a spontaneous combustion testing using DSC curves. In this example, Applicant determined the time at which cotton bar mops soiled with either linseed oil or soybean oil spontaneously combusted. Applicant also determined whether impregnating bar mops with a chelating agent, such as GLDA in an acidic form, prolonged the time at which these bar mops spontaneously combusted. Applicant obtained cotton bar mops weighing approximately 60 grams each. Some of the bar mops were soiled with linseed oil and others were soiled with soybean oil. The amount of oil applied to each bar mop was 30% of the weight of the bar mop. The oils were allowed to set on the bar mops overnight. Applicant then loosely packed four bar mops (containing the same oil) into a paint can with holes punched in the side toward the bottom for greater air flow. A thermocouple was also placed in the paint can. The paint can was then placed on top of a hot plate set at a desired temperature. Applicant then monitored the bar mops and thermocouple and ended the experiment once one of the following takes place: (1) the temperature of the bar mops reaches 400° F., (2) smoke appears, or (3) eight to eleven hours passes without (1) or (2) occurring. Applicant performed this experiment for the following bar mop types:

1. 20% soiled with linseed oil.
2. 20% soiled with linseed oil.
3. 26% soiled with linseed oil.
4. 40% soiled with linseed oil.
5. 19% soiled with soybean oil.
6. 25% soiled with soybean oil.
7. 30% soiled with soybean oil.
8. 30% soiled with soybean oil.
9. 30% soiled with soybean oil.
10. Baseline; no oil.

Figure 7:
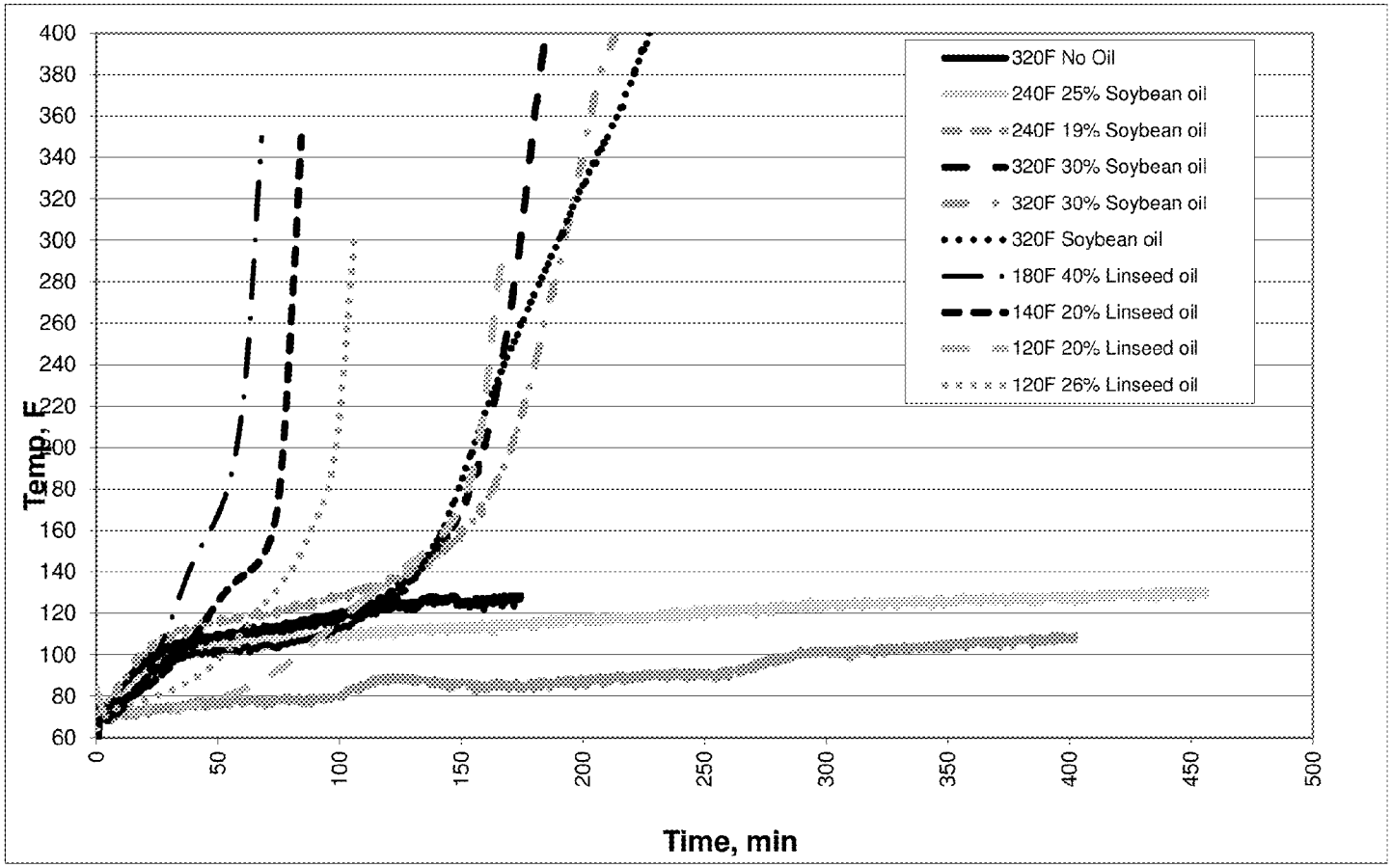
FIG. 7 is a graph showing time spontaneous combustion occurs for bar mops soiled with linseed and soybean oils.

The results are shown on FIG. 7.

Example #4

In this example, Applicant sought to determine the effect on spontaneous combustion in which the chelating agent was applied to the swatch either before or after the swatch was soiled with heavy metal spiked soybean oil, specifically iron. Applicant obtained cotton bar mops weighing approximately 60 grams each. Applicant impregnated some of the bar mops with a 250 ppm chelating agent solution and others with a 500 ppm of chelating agent solution, specifically Dissolvine GL-38S. The bar mops were allowed to air dry overnight. Applicant then soiled each of these bar mops with heavy metal spiked, 2 ppm, soybean oil. Applicant then soiled some bar mops with heavy metal spiked, 2 ppm, soybean oil and then treated the bar mop with a 250 ppm chelating agent solution, specifically Dissolvine GL-38S. The amount of oil applied to each towel was 30% of the weight of the bar towel. Applicant then set aside some bar mops that did not include a chelating agent or soybean oil to be used as a baseline. Applicant then loosely packed four bar mops of the same type into a paint can. A thermocouple was also placed in the paint can. The paint can was then placed on top of a hot plate set at a desired temperature. Applicant then monitored the bar mops and thermocouple and ended the experiment once one of the following takes place: (1) the temperature of the bar mops reaches 400° F., (2) smoke appears, or (3) eight to eleven hours passes without (1) or (2) occurring. Applicant performed this experiment for the following bar mop types:

1. Baseline; no oil, no chelating agent treatment.
2. 30% soiled with soybean oil, no chelating agent treatment (set #1).
3. 30% soiled with soybean oil, no chelating agent treatment (set #2).
4. 30% soiled with soybean oil, no chelating agent treatment (set #3).
5. 30% soiled with 2 ppm spiked soybean oil, no chelating agent treatment.
6. Impregnated with a 250 ppm chelating agent solution, (after drying) 30% soiled with 2 ppm spiked soybean oil.
7. Impregnated with a 500 ppm chelating agent solution, (after drying) 30% soiled with 2 ppm spiked soybean oil.
8. 30% soiled with 2 ppm spiked soybean oil, 250 ppm chelating agent solution.

Figure 8:
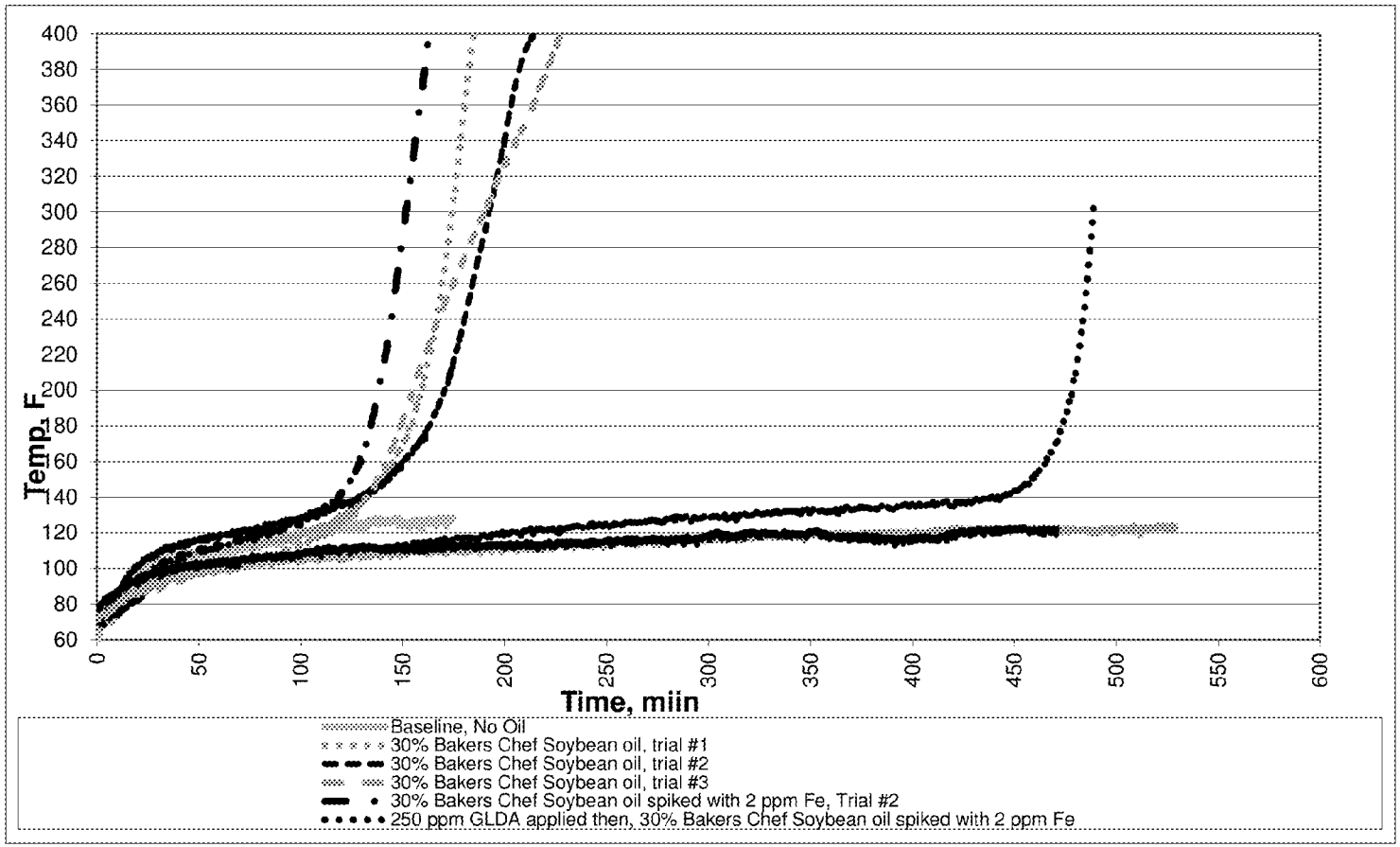
FIG. 8 is a graph showing time spontaneous combustion occurs for bar mops soiled with soybean oil spiked with 2 ppm iron and treated with a chelating agent.

The results are shown in FIG. 8. These results show that the chelating agent significantly delays the time at which spontaneous combustion occurs.

Example #5

Applicant compared the time at which untreated bar mops spontaneously combusted with the time at which bar mops treated with acidic GLDA spontaneously combusted. Some bar mops were only treated with Bakers Chef soybean oil. Others were treated with an injection sour and a chelating agent, specifically Dissolvine GLDA-38S either as two charges or mixed together, and then spiked with Bakers Chef soybean oil. Some were first treated with acidic GLDA before spiked with the Bakers Chef soybean oil. Finally, others were treated with Bakers Chef soybean oil then spiked with iron.

Applicant used cotton bar mops weighing approximately 60 grams each. The mops were first treated with acidic GLDA the day prior to the spontaneous combustion test and were then allowed to dry overnight. The morning of the test, the oil was sprayed onto the bar mops at 30% weight of the bar mop. Applicant then loosely packed each bar mop into a paint can with holes punched in the side toward the bottom for greater air flow. A thermocouple was placed in the paint can and the paint can was then placed on top of a hot plate set at a desired temperature. Applicant then monitored the bar mops and thermocouple and ended the experiment once one of the following takes place: (1) the temperature of the bar mops reaches 400° F., (2) there is an onset of sharp rise in temperature, or (3) eight to eleven hours passes without (1) or (2) occurring. Applicant performed this experiment for the following bar mop types:

1. 30% soiled with Bakers Chef soybean oil.
2. 30% soiled with Bakers Chef soybean oil.
3. 30% soiled with Bakers Chef soybean oil.
4. 300 ppm GLDA+15 ppm sour applied as two charges then 30% soiled with spiked Bakers Chef soybean oil with 2 ppm iron.
5. 300 ppm GLDA+15 ppm sour mixed together and applied as one charge then 30% soiled with spiked Bakers Chef soybean oil with 2 ppm iron.
6. 25 ppm GLDA at 7.26 pH then 30% soiled with Bakers Chef soybean oil.
7. 25 ppm GLDA at 5.29 pH then 30% soiled with Bakers Chef soybean oil.
8. 30% soiled with Bakers Chef soybean oil with 2 ppm iron.
9. 30% soiled with Bakers Chef soybean oil with 2 ppm iron.
10. 30% soiled with Bakers Chef soybean oil with 2 ppm iron.

Figure 9:
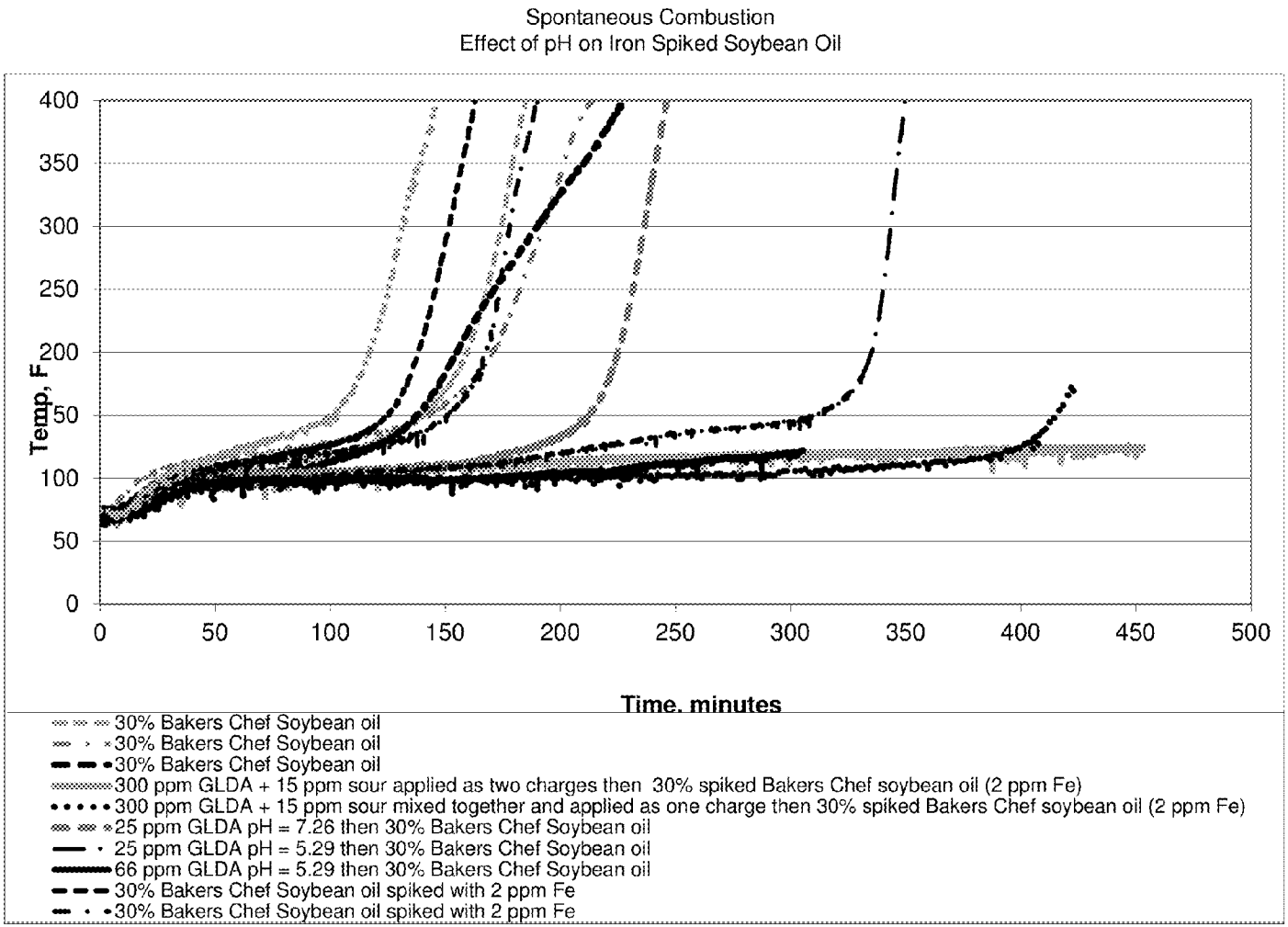
FIG. 9 is a graph showing time spontaneous combustion occurs for bar mops soiled with soybean oil and treated with GLDA in an acidic pH.

The results show that bar mops treated with acidic GLDA are much more effective at preventing laundry fires than those bar mops left untreated. Specifically, the control bar mops containing only 30% by weight Bakers Chef soybean oil showed an onset of steep temperature rise between 150-180 minutes. In comparison, bar mops soaked in a solution of GLDA at a pH of 7.25 then similarly loaded with 30% Bakers Chef soybean oil did not show a steep temperature rise until after 230 minutes. Treating the same mop with an even more acidic GLDA at a pH of 5.29 delayed the steep temperature rise even further, to roughly 340 minutes. The results are displayed on FIG. 9.

Example #6

Figure 10:
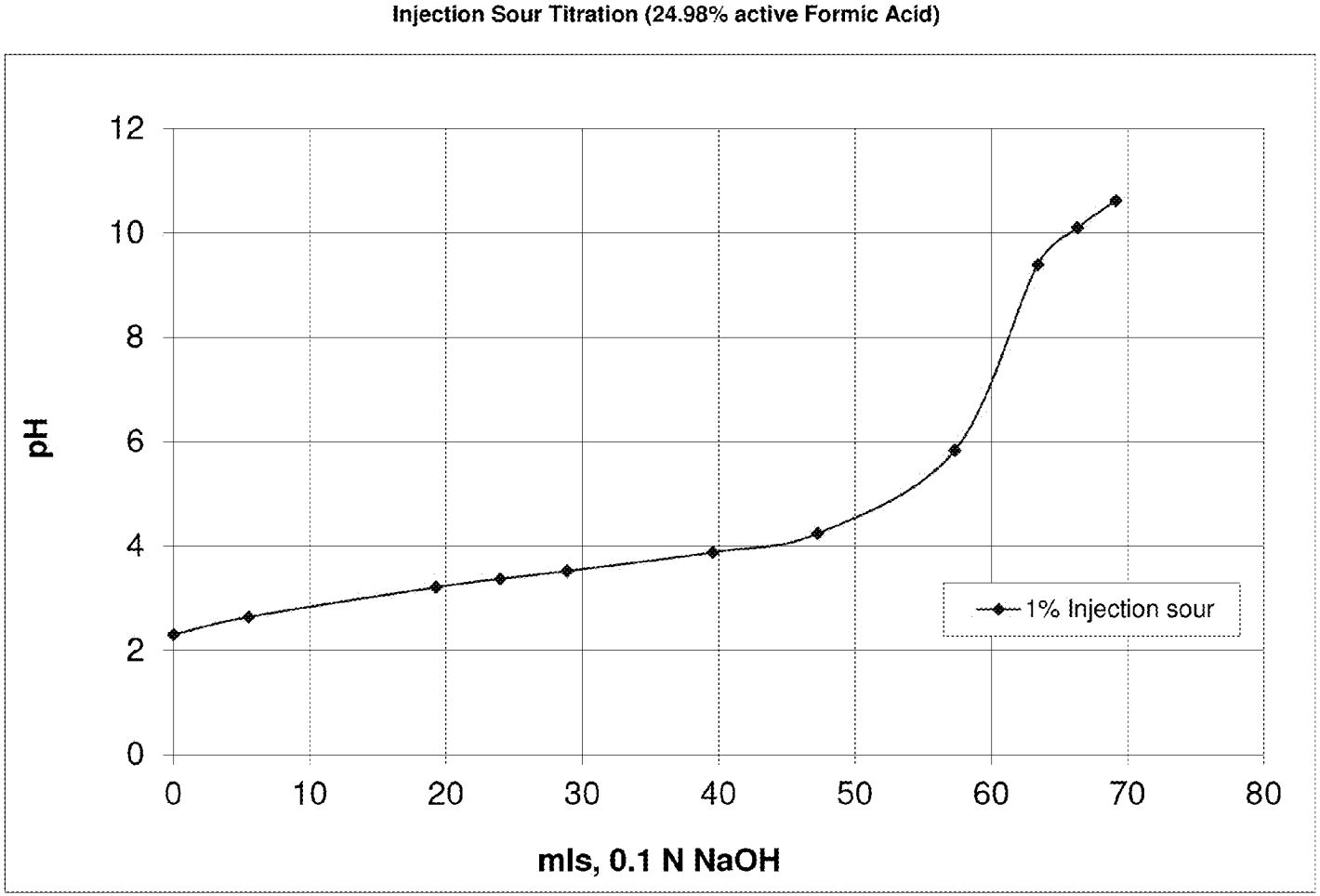
FIG. 10 is a graph showing the titration curve for injection sour.

Applicant sought to determine whether it was possible to formulate souring compositions comprising acidic GLDA which would provide dual benefits of both souring and fire prevention protection. Applicant formulated different prototype sour compositions. Formula compositions are displayed in table 6 below. For example, formula #3 is based on acidic GLDA (40% active) from Akzo Nobel. Formulas #4 and #5 are different mixtures of formic acid with acidic GLDA (40% active). The injection sour is a formic acid-based in-line sour composition. The injection sour titration curve with 0.1 N sodium hydroxide is shown in FIG. 10.

TABLE 6

| | injection sour, 972257 | EXP #1 | EXP #2 | EXP #3 | EXP #4 | EXP #5 |
|---|---|---|---|---|---|---|
| Water Deionized TNK | 72.24 | 11.00 | 17.00 | 37.50 | 37.50 | 67.00 |
| Formic Acid 90% Tech DRM | 27.76 | 4.50 | | | 5.00 | 23.00 |
| GLDA, 38% | | 84.50 | 83.06 | | | |
| acid GLDA, 40% | | | | 62.50 | 57.50 | 10.00 |
| % Active acid | 24.98 | 36.16 | 31.56 | 25.00 | 27.50 | 24.70 |
| 100% pH | | | | | | |
| at 1 oz/cwt, ppm GLDA | | 132.0 | 130.6 | 97.0 | 89.6 | 15.6 |
| ppm active GLDA | | 50.2 | 52.2 | 38.8 | 35.9 | 6.2 |

Figure 11:
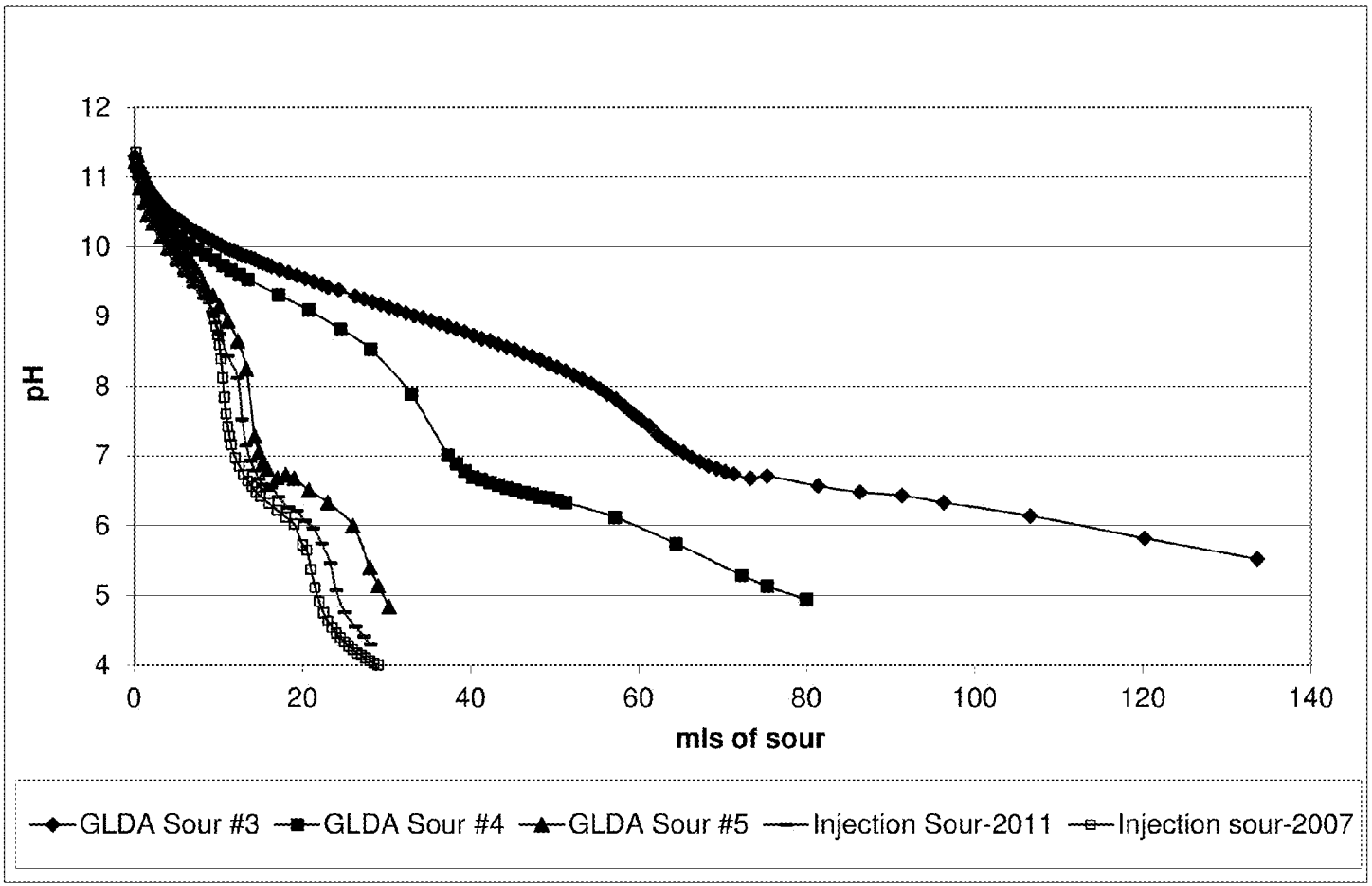
FIG. 11 is a graph curve of acidic GLDA as a souring agent.

FIG. 11 compares the titration curves of a fixed alkalinity source (150 mL of 5% sodium carbonate) versus the formulas for experiments #3-5 in Table 6 and two samples of injection sour. Souring capability is a measurement of the ability of a composition to neutralize carried-over alkalinity. The data show that the souring capability of experiment #5 matches well with injection sour. This data, combined with the data in example #5, show that sour compositions can be formulated comprising acidic GLDA which provide dual benefits of both souring and providing fire prevention protection.

The data further support that the acidic GLDA obtained from Akzo Nobel is not acidic enough to support the dual properties of souring and providing fire prevention protection. The respective pKa's for GLDA acid are provided in Table 7 below. All except the last proton are available for neutralization.

TABLE 7

| | |
|---|---|
| pKa1 | ~1-2 |
| pKa2 | 2.56 |

TABLE 7-continued

| | |
|---|---|
| pKa3 | 3.49 |
| pKa4 | 5.03 |
| pKa5 | 9.36 |

Obviously, many modifications and variations of the invention as hereinbefore set forth can be made without departing from the spirit and scope thereof, and, therefore, only such limitations should be imposed as are indicated by the appended claims.

We claim:

1. A method of laundering an article contaminated with a non-trans fat soil, the method comprising:

washing the article contaminated with non-trans fat soil; and rinsing the article in an acidic solution consisting of (a) water, (b) L-glutamic acid, N,N-diacetic acid (GLDA) in an amount and at a pH effective for preventing spontaneous combustion of the article contaminated with non-trans fat soil, and (c) optionally an additional souring agent, wherein the GLDA and the optional additional souring agent are in an amount sufficient to neutralize carried-over alkalinity from the washing step.

2. The method of claim 1 wherein additional steps occur before the rinsing step.

3. The method of claim 1 wherein the amount of GLDA is an amount that lowers an area of exotherm of the non-trans fat soil by about 20%.

4. The method of claim 1 wherein the amount of GLDA is an amount that delays a time of peak heat flow of the non-trans fat soil by about 20%.

5. The method of claim 1 wherein the non-trans fat soil includes heavy metal ions.

6. The method of claim 1 wherein the amount of GLDA is also effective to hinder metal complexation of free fatty acid salts.

7. The method of claim 1 wherein the method further comprises drying the article after the rinsing step.

8. The method of claim 1, wherein the amount of GLDA in the acidic solution is from 6.2 to 300 ppm.

9. The method of claim 1, wherein the amount of GLDA in the acidic solution is from 6.2 to 100 ppm.

10. The method of claim 1, wherein the amount of GLDA in the acidic solution is from 25 to about 250 ppm.

11. The method of claim 1, wherein the amount of GLDA is also effective for chelating heavy metals present in the non-trans fat soil.

12. The method of claim 1, wherein the effective amount of GLDA hinders polymerization of non-trans fats in the non-trans fat soil.

* * * * *